US008974171B2

(12) United States Patent
Shirao et al.

(10) Patent No.: US 8,974,171 B2
(45) Date of Patent: Mar. 10, 2015

(54) WORK VEHICLE

(75) Inventors: Atsushi Shirao, Komatsu (JP); Masanori Ikari, Komatsu (JP)

(73) Assignee: Komatsu Ltd., Tokyo (JP)

( * ) Notice: Subject to any disclaimer, the term of this patent is extended or adjusted under 35 U.S.C. 154(b) by 591 days.

(21) Appl. No.: 13/318,407

(22) PCT Filed: May 11, 2010

(86) PCT No.: PCT/JP2010/057964

§ 371 (c)(1),
(2), (4) Date: Nov. 1, 2011

(87) PCT Pub. No.: WO2010/131654

PCT Pub. Date: Nov. 18, 2010

(65) Prior Publication Data

US 2012/0057956 A1 Mar. 8, 2012

(30) Foreign Application Priority Data

May 13, 2009 (JP) ..... 2009-116753

(51) Int. Cl.
*E02F 3/43* (2006.01)

(52) U.S. Cl.
CPC ..... *E02F 3/432* (2013.01); *E02F 3/433* (2013.01); *F15B 2211/6336* (2013.01)
USPC ..... 414/700; 414/699; 414/685; 414/723; 701/50

(58) Field of Classification Search
CPC ..... A01C 3/04; B66F 9/065; E02F 3/3405; E02F 3/3408; E02F 3/3411; E02F 3/43; E02F 3/431; E02F 3/432; E02F 3/433; E02F 3/436
USPC ..... 414/699, 700, 701, 706, 707, 708, 723
See application file for complete search history.

(56) References Cited

U.S. PATENT DOCUMENTS 3,512,665 A * 5/1970 Westendorf ..... 414/723
3,536,216 A * 10/1970 Woolman et al. ..... 414/694

(Continued)

FOREIGN PATENT DOCUMENTS

CN 201155116 Y 11/2008
CN 101336324 A 12/2008

(Continued)

OTHER PUBLICATIONS

International Search Report of corresponding PCT Application No. PCT/JP2010/057964.

(Continued)

*Primary Examiner* — Saul Rodriguez
*Assistant Examiner* — Brendan Tighe
(74) *Attorney, Agent, or Firm* — Global IP Counselors, LLP

(57) ABSTRACT

A work vehicle includes a pair of booms, a link mechanism and a control unit. The booms are attached to a front part of a vehicle body in an upwardly and downwardly rotatable state. The link mechanism couples a working unit to tips of the booms. The link mechanism is configured to keep the working unit in a posture generally parallel to the ground without rotating the working unit with respect to the ground while the booms are elevated from a position where the working unit is disposed on the ground when the working unit is a fork. The control unit is configured to execute a tilt angle adjusting control for the working unit in accordance with variation in an angle of the booms while the booms are elevated when a tilt angle of the working unit is greater than or equal to a predetermined threshold.

18 Claims, 10 Drawing Sheets

(56) References Cited

U.S. PATENT DOCUMENTS

| | | | | |
|---|---|---|---|---|
| 3,726,428 | A * | 4/1973 | Lark et al. | 414/700 |
| 4,825,568 | A * | 5/1989 | Kawamura et al. | 37/442 |
| 4,844,685 | A * | 7/1989 | Sagaser | 414/700 |
| 4,964,779 | A * | 10/1990 | Sagaser | 414/708 |
| 5,083,894 | A | 1/1992 | Ikari et al. | |
| 5,356,260 | A | 10/1994 | Ikari et al. | |
| 5,782,018 | A * | 7/1998 | Tozawa et al. | 37/348 |
| 7,140,830 | B2 * | 11/2006 | Berger et al. | 414/699 |
| 7,530,185 | B2 * | 5/2009 | Trifunovic | 37/348 |
| 8,500,387 | B2 * | 8/2013 | Trifunovic | 414/699 |
| 8,538,640 | B2 * | 9/2013 | Ota | 701/50 |
| 8,858,151 | B2 * | 10/2014 | Atkinson | 414/685 |
| 2002/0173900 | A1 * | 11/2002 | Vonnoe et al. | 701/108 |
| 2004/0117092 | A1 * | 6/2004 | Budde | 701/50 |
| 2004/0136821 | A1 * | 7/2004 | Berger et al. | 414/699 |
| 2005/0216105 | A1 * | 9/2005 | Tabor | 700/63 |
| 2006/0096137 | A1 * | 5/2006 | Hendron et al. | 37/348 |
| 2006/0123673 | A1 * | 6/2006 | Glover | 37/348 |
| 2006/0291987 | A1 | 12/2006 | Osanai et al. | |
| 2007/0199438 | A1 * | 8/2007 | Wada | 91/511 |
| 2008/0244937 | A1 * | 10/2008 | Florean | 37/416 |
| 2008/0263911 | A1 * | 10/2008 | Shoenmaker et al. | 37/348 |
| 2008/0313935 | A1 * | 12/2008 | Trifunovic | 37/413 |
| 2009/0003984 | A1 | 1/2009 | Osanai et al. | |
| 2009/0162177 | A1 * | 6/2009 | Nichols | 414/698 |
| 2009/0222176 | A1 * | 9/2009 | Florean et al. | 701/50 |
| 2010/0215469 | A1 * | 8/2010 | Trifunovic | 414/699 |
| 2010/0226744 | A1 * | 9/2010 | Trifunovic | 414/700 |
| 2010/0254793 | A1 * | 10/2010 | Trifunovic | 414/700 |
| 2011/0150614 | A1 * | 6/2011 | Nicholson et al. | 414/685 |
| 2012/0024146 | A1 * | 2/2012 | Saito | 91/525 |
| 2012/0046839 | A1 * | 2/2012 | Hanson | 701/50 |
| 2012/0251285 | A1 * | 10/2012 | Oyama et al. | 414/722 |
| 2012/0315120 | A1 * | 12/2012 | Hyder | 414/699 |
| 2012/0321425 | A1 * | 12/2012 | Shatters et al. | 414/700 |
| 2012/0323451 | A1 * | 12/2012 | Shatters et al. | 701/50 |
| 2012/0330515 | A1 * | 12/2012 | Numazaki et al. | 701/50 |
| 2013/0004282 | A1 * | 1/2013 | Grimes et al. | 414/698 |
| 2013/0045072 | A1 * | 2/2013 | Jensen | 414/699 |
| 2013/0047598 | A1 * | 2/2013 | Shimazu et al. | 60/462 |
| 2014/0129093 | A1 * | 5/2014 | Shirao et al. | 701/50 |

FOREIGN PATENT DOCUMENTS

| | | | |
|---|---|---|---|
| EP | 1 650 357 | A1 | 4/2006 |
| JP | 1-163325 | A | 6/1989 |
| JP | 1-182419 | A | 7/1989 |
| JP | 4-41824 | A | 2/1992 |
| JP | 5-51940 | A | 3/1993 |
| JP | 6-293498 | A | 10/1994 |
| JP | 2000-328596 | A | 11/2000 |
| JP | 2007-224511 | A | 9/2007 |
| JP | 2008-184787 | A | 8/2008 |
| WO | WO 2005/012653 | A1 | 2/2005 |

OTHER PUBLICATIONS

Japanese Notice of Allowance issued on Jul. 2, 2013 for the corresponding Japanese Patent Application No. 2012-149801.

Chinese Office Action issued on Jul. 8, 2013 for the corresponding Chinese Patent Application No. 201080021042.3.

* cited by examiner

WORK VEHICLE

CROSS-REFERENCE TO RELATED APPLICATIONS

This national phase application claims priority to Japanese Patent Application No. 2009-116753 filed on May 13, 2009. The entire disclosure of Japanese Patent Application No. 2009-116753 is hereby incorporated herein by reference.

TECHNICAL FIELD

The present invention relates to a work vehicle embedded with a link mechanism configured to drive a working unit attached to the tips of booms.

BACKGROUND ART

The work vehicles such as the wheel loaders have been operated for executing works with various types of attachments (working units) such as a bucket or a fork. A suitable one of the attachments is herein selected in accordance with work content and is attached to the tips of booms rotatably mounted to the front part of the vehicle body.

For example, Patent Literature 1 describes a wheel loader embedded with a Z-bar link as a mechanism for driving the aforementioned working unit (e.g., a bucket and a fork). In the wheel loader, the Z-bar link can perform an action similar to that of a parallel link mechanism. In the present specification, the mechanism using the Z-bar link described in Patent Literature 1 and the parallel link mechanism will be hereinafter collectively referred to as "a parallel link motion mechanism".

Specifically, the parallel link motion mechanism is configured to keep a fork attached as a working unit to the booms in a parallel position to the ground in elevating the booms from a position where the fork is disposed on the ground. Therefore, operators can operate the work vehicles (e.g., the wheel loaders) equipped with the fork for executing a variety of works (e.g., loading of baggage) without adjusting the tilt angle of the fork.

SUMMARY

However, the well-known work vehicles with the parallel link motion mechanism have the following drawback.

Specifically, the work vehicles with the parallel link motion mechanism have a feature of maintaining the posture of a working unit regardless of the angle of the booms when a fork is attached as the working unit to the booms. When a bucket is attached to the booms instead of the fork, the bucket is configured to be lifted up at a roughly constant relative angle with respect to the booms in elevating the booms to the maximum tilt angle for executing works (e.g., scooping up of earth and sand).

Under the condition, the bucket may be tilted forwards and earth and sand may be spilled out of the bucket. Therefore, operators are required to perform an operation again for positioning the bucket back to the horizontal posture.

In short, the normal Z-bar link mechanism, configured not to perform a parallel link action, is designed for executing works using the bucket attached thereto as the working unit. Therefore, when the bucket is attached to the normal Z-bar link mechanism, operators are not required to perform the aforementioned operation again in executing scooping up of earth and sand. By contrast, the parallel link motion mechanism is designed for executing works using the fork attached thereto as the attachment. A drawback is thereby produced that the parallel link motion mechanism is inconvenience in scooping up earth and sand when the bucket is attached thereto.

It is an object of the present invention to provide a work vehicle embedded with a parallel link motion mechanism for reducing the amount of contents spilled out of an attachment and efficiently executing works such as scooping up of earth and sand even when a bucket is attached thereto as the attachment.

A work vehicle according to a first aspect of the present invention includes a pair of booms, a link mechanism and a control unit. The booms are attached to a front part of a vehicle body in an upwardly and downwardly rotatable state. The link mechanism couples a working unit to tips of the booms. When the working unit is a fork, the link mechanism is configured to keep the fork in a posture generally parallel to the ground without rotating the fork with respect to the ground while the booms are elevated from a position where the fork is disposed on the ground. The control unit is configured to execute a tilt angle adjusting control for the working unit in accordance with variation in an angle of the booms in elevating the booms from the position where the working unit is disposed on the ground when a tilt angle of the working unit is greater than or equal to a predetermined threshold.

When the work vehicle embedded with the parallel link motion mechanism scoops up earth and sand using the bucket attached to the booms, the tilt angle of the bucket is configured to be automatically adjusted in maximally forwardly tilting the bucket filled with earth and sand scooped therein according to the angle of the booms and elevating the booms under the condition when the tilt angle of the bucket is greater than or equal to a predetermined threshold on the onset of boom elevating action.

The aforementioned parallel link motion mechanism is not herein limited to a particular mechanism as long as it can keep a fork attached to the tips of the booms in a posture parallel to the ground in elevating the booms from a position where the fork is disposed on the ground. Further, the parallel link motion mechanism widely includes a PZ-bar link mechanism, which is classified as the Z-bar link mechanism, as well as a normal parallel link mechanism. The PZ-bar link mechanism is configured to perform an action of keeping the parallel posture of the fork although having a Z-bar link structure (see Patent Literature 1)). Further, the threshold is herein set as the condition for executing the aforementioned control in order to reduce the amount of contents spilled out of a working unit in executing scooping up of earth and sand when a bucket is attached as the working unit to the booms.

Accordingly, the bucket can be automatically kept in a roughly parallel posture without executing an operation of adjusting the tilt angle of the bucket again even when scooping up of earth and sand is executed with the bucket attached as the working unit to the booms. Even in the work vehicles (e.g., the wheel loaders) equipped with the parallel link motion mechanism, degradation of work performance can be avoided when the bucket is attached to the booms and works can be thereby efficiently executed using the bucket. Further, through an appropriate setting of the threshold, activation of the aforementioned control can be prevented when the fork is attached to the booms. Therefore, degradation of work performance can be prevented when the fork is attached to the booms.

A work vehicle according to a second aspect of the present invention relates to the work vehicle according to the first aspect of the present invention. In the work vehicle, the threshold is at least one of a first threshold as an upper limit and a second threshold as a lower limit.

According to the work vehicle of the second aspect of the present invention, at least either of the upper limit (i.e., the first threshold) and the lower limit (i.e., the second threshold) is used as the threshold for determining either activation or deactivation of the aforementioned tilt angle adjusting control for the working unit in elevating the booms.

Accordingly, the aforementioned control can be executed only when the tilt angle of the working unit on the onset of elevation of the booms satisfies any one of the conditions: an angle greater than or equal to the first threshold; an angle less than or equal to the second threshold; and an angle falling in a range from the second threshold to the first threshold. Therefore, work performance can be enhanced by allowing activation of the aforementioned control in scooping up earth and sand but preventing automatic activation of the aforementioned control in executing works excluding scooping up of earth and sand.

A work vehicle according to a third aspect of the present invention relates to the work vehicle according to one of the first and second aspects of the present invention. In the work vehicle, the threshold is flexible.

According to the work vehicle of the third aspect of the present invention, the threshold is flexible for determining either activation or deactivation of the aforementioned tilt angle adjusting control.

Accordingly, the threshold can be set to be in an appropriate range in accordance with a variety of conditions such as the size, the shape and the type of the bucket to be attached to the booms. Therefore, work performance can be more effectively enhanced by optimally setting the threshold in accordance with the various conditions.

A work vehicle according to a fourth aspect of the present invention relates to the work vehicle according to one of the first to third aspects of the present invention. In the work vehicle, the threshold is set to be in an angular range of roughly 35 to 40 degrees.

According to the work vehicle of the fourth aspect of the present invention, the tilt angle of 35 to 40 degrees is set as the threshold for determining either activation or deactivation of the aforementioned tilt angle adjusting control.

Accordingly, the posture of the bucket is adjusted in accordance with variation in angle of the boom even when the bucket is fully tilted and the booms are then elevated in works such as scooping. Therefore, it is possible to reduce the amount of contents spilled out of the bucket. In other words, works such as scooping up of earth and sand can be efficiently executed even when the bucket is attached as a working unit to the booms.

It should be noted that the angle is approximately the same as the fully tilted angle, and therefore, the aforementioned control is not executed in elevating the booms equipped with the fork as the attachment positioned roughly in parallel to the ground. Therefore, no negative impact is imposed on the parallel-link-like action. In other words, the aforementioned control is not executed when the fork is attached to the booms. It is thereby possible to prevent degradation of work efficiency when the fork is attached to the booms.

A work vehicle according to a fifth aspect of the present invention relates to the work vehicle according to one of the first to fourth aspects of the present invention. The work vehicle further includes a selection mechanism configured to switch between activation and deactivation of the tilt angle adjusting control.

According to the work vehicle of the fifth aspect of the present invention, an operator is allowed to switch between activation and deactivation of the aforementioned tilt angle adjusting control.

Therefore, activation and deactivation of the aforementioned control can be arbitrarily set in accordance with work conditions (e.g., scooping up of earth and sand when the bucket is attached to the booms), preference of an operator of the work vehicle and so forth without constantly executing the aforementioned control. Further, activation of the tilt angle adjusting control can be reliably prevented when the fork is attached to the booms.

A work vehicle according to a sixth aspect of the present invention relates to the work vehicle according to one of the first to fifth aspects of the present invention. The control unit further includes a tilt correction amount adjusting mechanism configured to adjust a control amount of the tilt angle in the tilt angle adjusting control.

According to the work vehicle of the sixth aspect of the present invention, an operator is allowed to determine the amount of tilt angle to be adjusted in accordance with the angle of the booms during execution of the aforementioned tilt angle adjusting control.

Accordingly, works can be executed while an appropriate control is executed in accordance with a variety of conditions such as the size, the shape and the type of the bucket. Therefore, work performance can be more effectively enhanced by optimally setting the adjustment amount in accordance with the various conditions.

DESCRIPTION OF THE EMBODIMENTS

Exemplary Embodiment 1

A wheel loader (work vehicle) 50 according to an exemplary embodiment of the present invention will be hereinafter explained with reference to FIGS. 1 to 6.

Entire Structure of Wheel Loader 50

Figure 1:
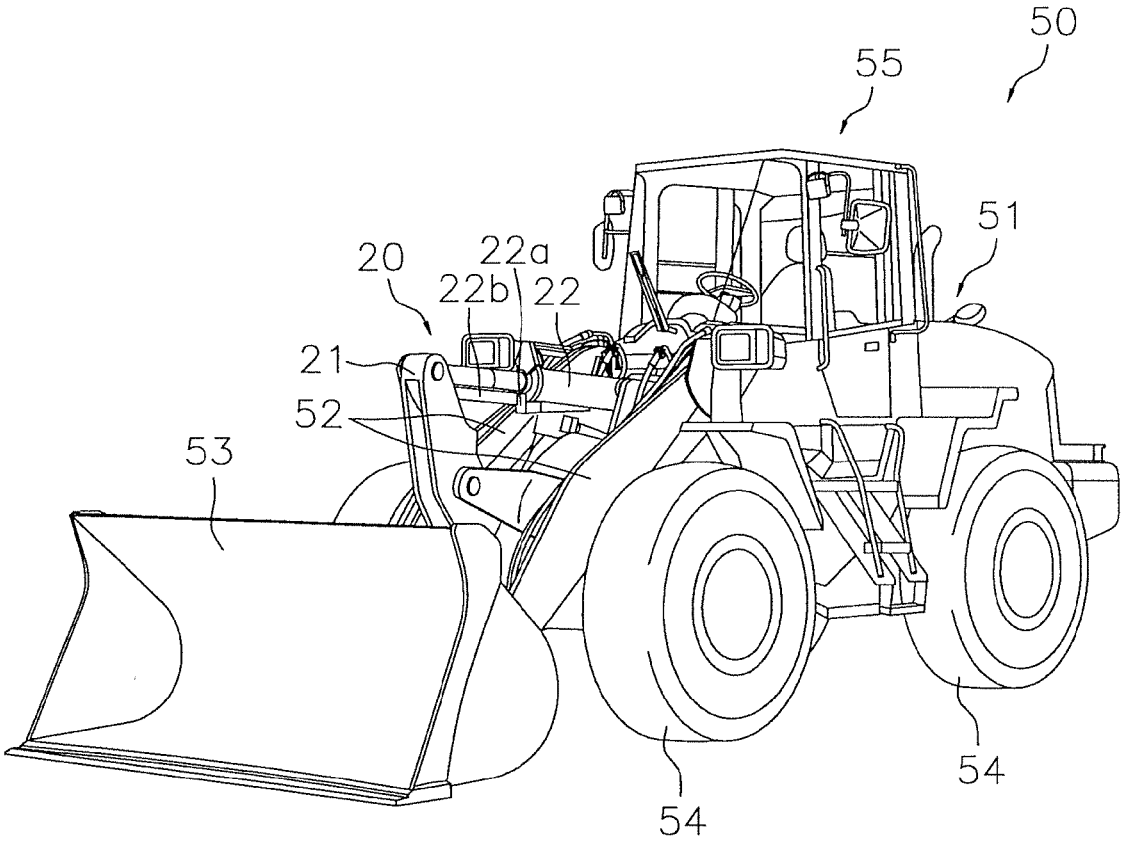
FIG. 1 is a perspective view of a wheel loader according to an exemplary embodiment of the present invention.

As illustrated in FIG. 1, the wheel loader 50 of the present exemplary embodiment includes a vehicle body 51, a pair of booms 52, a bucket 53, four wheels 54, a cab 55 and a link mechanism 20. The booms 52 are attached to the front part of the vehicle body 51. The bucket 53 is attached as a working unit to the tips of the booms 52. The wheels 54 are rotated while supporting the vehicle body 51 for causing the vehicle body 51 to travel. The cab 55 is mounted on the top of the vehicle body 51. The link mechanism 20 is configured to drive the booms 52 and the bucket 53. It should be noted that a fork is attachable to the tips of the booms 52 as a working unit instead of the bucket 53.

The vehicle body 51 includes an engine room for accommodating an engine and is provided with a controller (control unit) 30 (see FIG. 3) configured to control a variety of components such as control valves and actuators for driving the booms 52 and the bucket 53. It should be noted that control blocks formed by the controller 30 will be described in detail in the following paragraphs.

Figure 2:
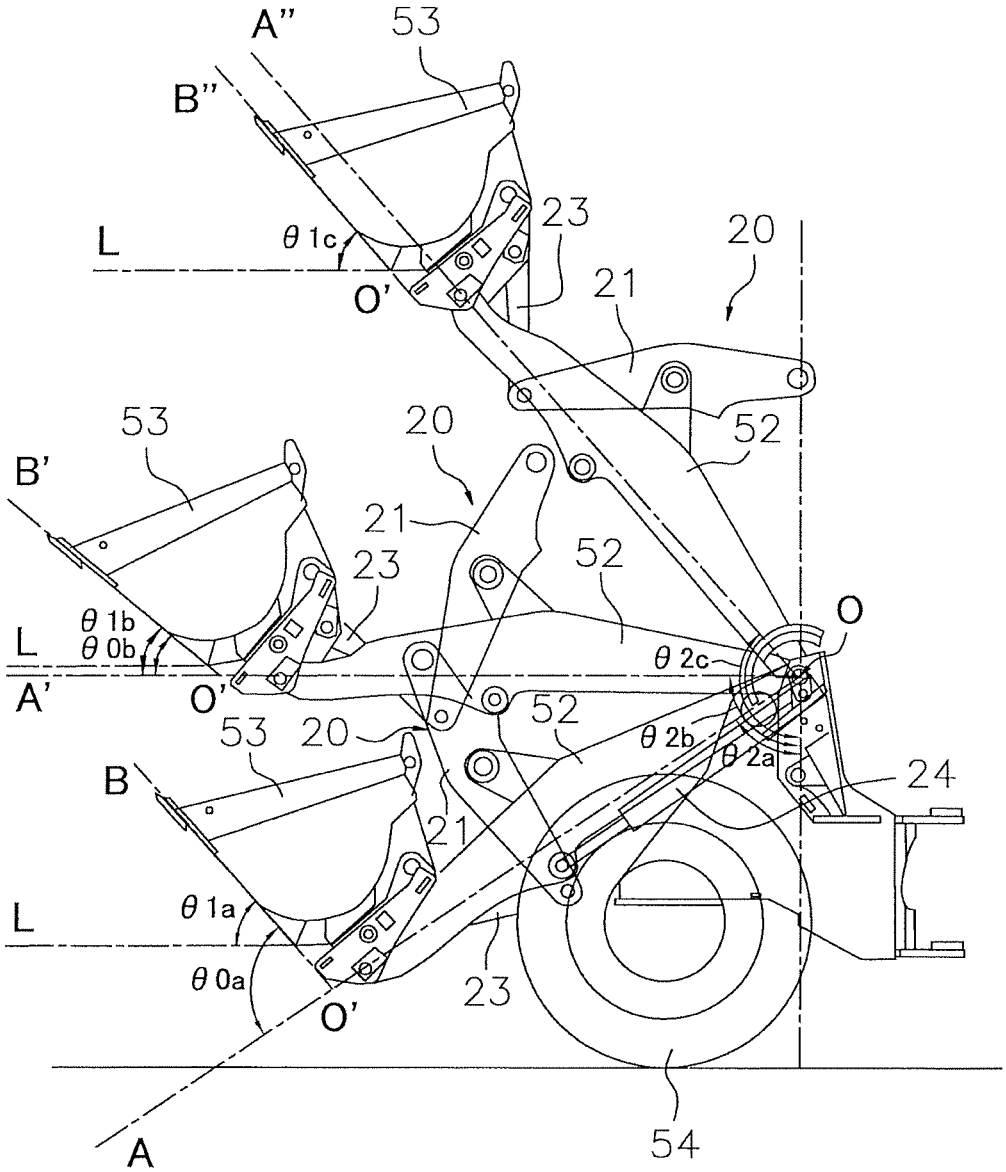
FIG. 2 is a side view of the wheel loader of FIG. 1, illustrating angles (postures) of a bucket when booms are gradually elevated.

As illustrated in FIG. 2, the booms 52 are members for lifting up the bucket 53 attached to the tips thereof. Each boom 52 is configured to be driven by a lift cylinder 24 disposed therealong.

The bucket 53 is attached to the tips of the booms 52. Tilting and dumping of the bucket 53 is executed by a bucket cylinder 22.

When a fork is attached to the tips of the booms 52 as a working unit, the link mechanism 20 is configured to keep the fork in a posture roughly parallel to the ground in elevating the booms 52 from the position where the fork is disposed on and parallel to the ground without operating the bucket cylinder 22. It should be noted that the detailed structure of the link mechanism 20 will be described in detail in the following paragraphs.

Link Mechanism 20

As illustrated in FIGS. 1 and 2, the link mechanism 20 includes a bell crank 21, the bucket cylinder 22, a joint link 23 and the pair of lift cylinders 24. The link mechanism 20 is configured to drive the booms 52 and the bucket 53.

The bell crank 21 is rotatably attached to the roughly longitudinal center parts of the booms 52. One end (i.e., the upper end) of the bell crank 21 is coupled to the bucket cylinder 22, while the other (i.e., the lower end) thereof is coupled to the joint link 23.

One end (i.e., a main-body-side end) of the bucket cylinder 22 is fixed to the vehicle body 51, while the other end (i.e., a telescopic driving-side end) thereof is coupled to the upper end of the bell crank 21.

Boom angle sensors (not illustrated in the figures) are disposed on the pivot parts 6 of the booms 52 coupled to the vehicle body 51 for detecting the angle (boom angle) of the booms 52.

Further, a proximity switch 22*a* and a detection bar 22*b* are disposed on the bucket cylinder 22 for detecting that the tilt angle of the bucket 53 exceeds a predetermined threshold.

The detection bar 22*b* is disposed on the rod-side part of the bucket cylinder 22, whereas the proximity switch 22*a* is disposed on the cylinder-side part of the bucket cylinder 22. When the bucket cylinder 22 is maximally expanded, the detection surface of the proximity switch 22*a* is not covered with the detection bar 22*b*. When the bucket cylinder 22 is gradually contracted from the maximally expanded condition, the detection surface of the proximity switch 22*a* is covered with the detection bar 22*b* in a predetermined position. The detection surface of the proximity switch 22*a* is then kept covered with the detection bar 22*b* until the bucket cylinder 22 is maximally contracted. In short, it is possible to detect whether or not the expanded/contracted amount of the bucket cylinder 22 exceeds a predetermined value by means of the proximity switch 22*a* and the detection bar 22*b*. It should be noted that the relative attachment position of the proximity switch 22*a* to the detection bar 22*b* is adjustable and the aforementioned threshold can be changed by adjusting the relative attachment position.

One end of the joint link 23 is movably coupled to the rear surface of the bucket 53, while the other end thereof is movably coupled to the lower end of the bell crank 21.

Controller 30

Figure 3:
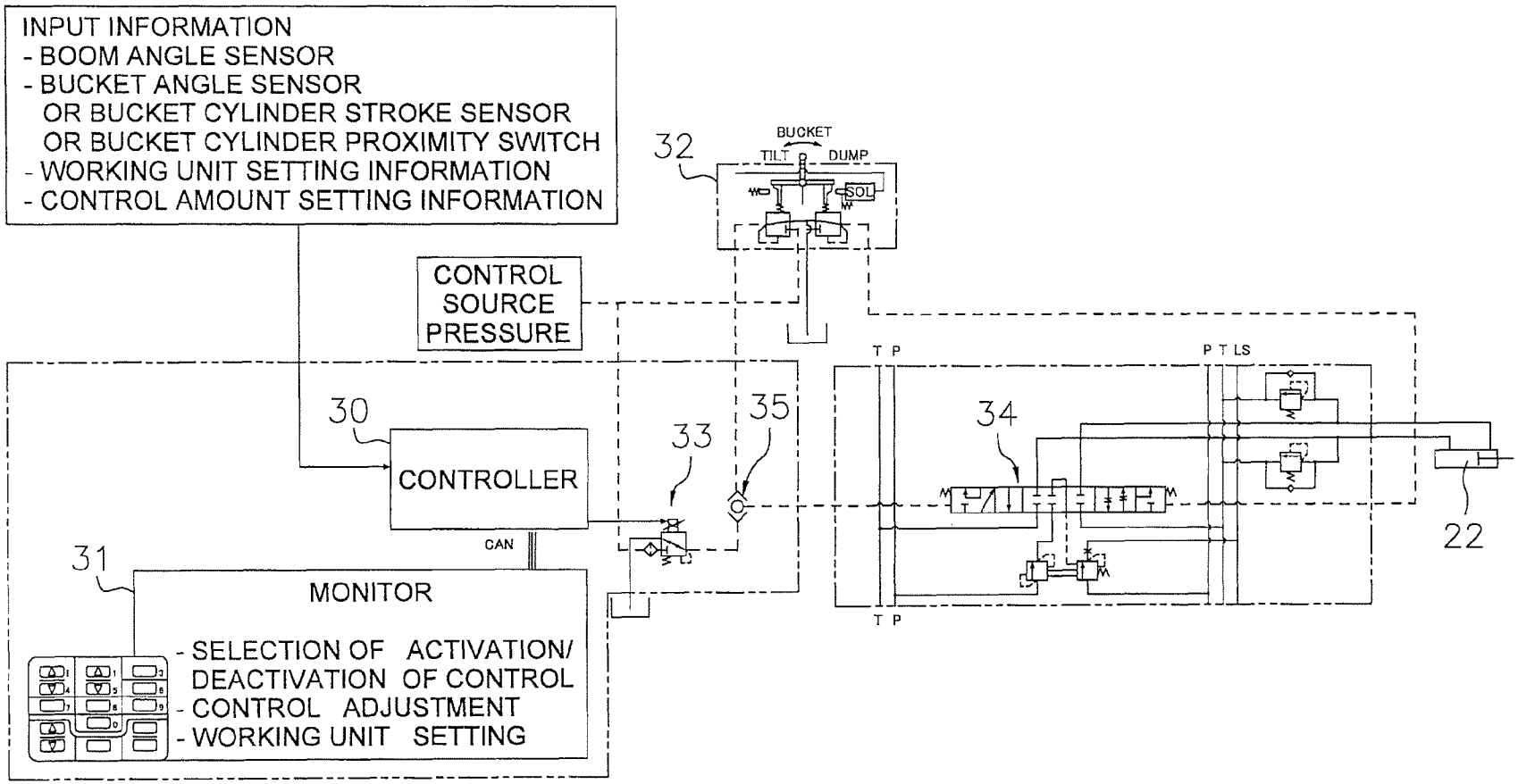
FIG. 3 is a circuit diagram of a hydraulic circuit for driving a bucket cylinder installed in the wheel loader of FIG. 1.

In the present exemplary embodiment, the control blocks are mainly formed by the controller 30 as represented in FIG. 3. Under a predetermined condition (to be described), the tilt angle of the bucket 53 (i.e., the posture of the bucket 53) is automatically controlled when the booms 52 are gradually elevated.

As represented in FIG. 3, the controller 30 is connected to a monitor (a selection mechanism, a corrected amount adjusting mechanism) 31 and an electromagnetic proportional decompression valve 33. The controller 30 is configured to receive a variety of input signals carrying information regarding the boom angle sensor, the proximity switch 22*a*, the attachment selector switch (attachment selection setting information) and the tilt angle adjusting control to be described (control amount adjusting information).

The monitor 31 is attached to the right or left of an operator's seat disposed in the cab 55 of the wheel loader 50. An operator is allowed to directly input information regarding selection of activation/deactivation of the tilt angle adjusting control and information regarding adjustment of the control amount. Thus, an operator can select either activation or deactivation of the tilt angle adjusting control and change the adjustment amount in the tilt angle adjusting control through the monitor 31. Further, an operator is allowed to directly input a variety of information regarding the working unit type such as a bucket or a fork (working unit setting information) using the monitor 31.

The electromagnetic proportional decompression valve 33 is configured to be actuated based on a command from the controller 30 and produce a pilot pressure. A higher pressure selector valve 35 is configured to select a higher one of the pilot pressure produced in the electromagnetic proportional decompression valve 33 and a pilot pressure produced in a bucket PPC valve 32. A bucket spool 34 is configured to be moved in accordance with the selected pilot pressure, and the bucket cylinder 22 is configured to be actuated. In other words, substantially no intervention is executed by the controller 30 with respect to the tilt action of the bucket 53 when the operating amount of a bucket operating lever is large and the pilot pressure in the bucket PPC valve 32 is greater than that in the electromagnetic proportional decompression valve 33. It should be noted that the tilt angle adjusting control for the bucket 53 by the controller 30 using the electromagnetic proportional decompression valve 33 will be explained in detail in the following paragraphs.

When an operator operates and sets the bucket operating lever disposed in the cab 55 to either a tilting position or a dumping position, the bucket PPC valve 32 is configured to be actuated for supplying a pilot pressurized oil with a pressure set in accordance with the lever operating amount to an actuating circuit of the bucket spool 34. In other words, the bucket PPC valve 32 is configured to be actuated in accordance with the operating amount of the operating lever by an operator and adjust the tilt angle of the bucket 53 in accordance with operator's intention.

The bucket spool 34 is configured to be actuated by means of the pilot pressurized oil supplied thereto from the bucket PPC valve 32. The bucket spool 34 is configured to drive the bucket cylinder 22 to either the tilting side or the dumping side. In other words, the bucket PPC valve 32 is configured to be actuated in accordance with the operating amount of the operating lever by an operator and adjust the tilt angle of the bucket 53 in accordance with operator's intention.

It should be noted that a cylinder for driving the lift cylinder 24 is similar to that of the bucket cylinder 22 and the booms are configured to be elevated and lowered in conjunction with an operation of an operating lever, although detailed explanation thereof will be hereinafter omitted because it is apparent to those skilled in the art.

As represented in FIG. 3, components such as the controller 30, the electromagnetic proportional decompression valve 33 and the higher pressure selector valve 35 are herein added to the bucket-side circuit. Accordingly, the bucket cylinder 22 is configured to be actuated based on a signal from the controller 30 even if the operating lever is not operated.

Tilt Angle Control for Bucket 53

The following relates to specific explanation of the aforementioned tilt angle adjusting control to be executed by the controller 30 with respect to the bucket 53.

Figure 4:
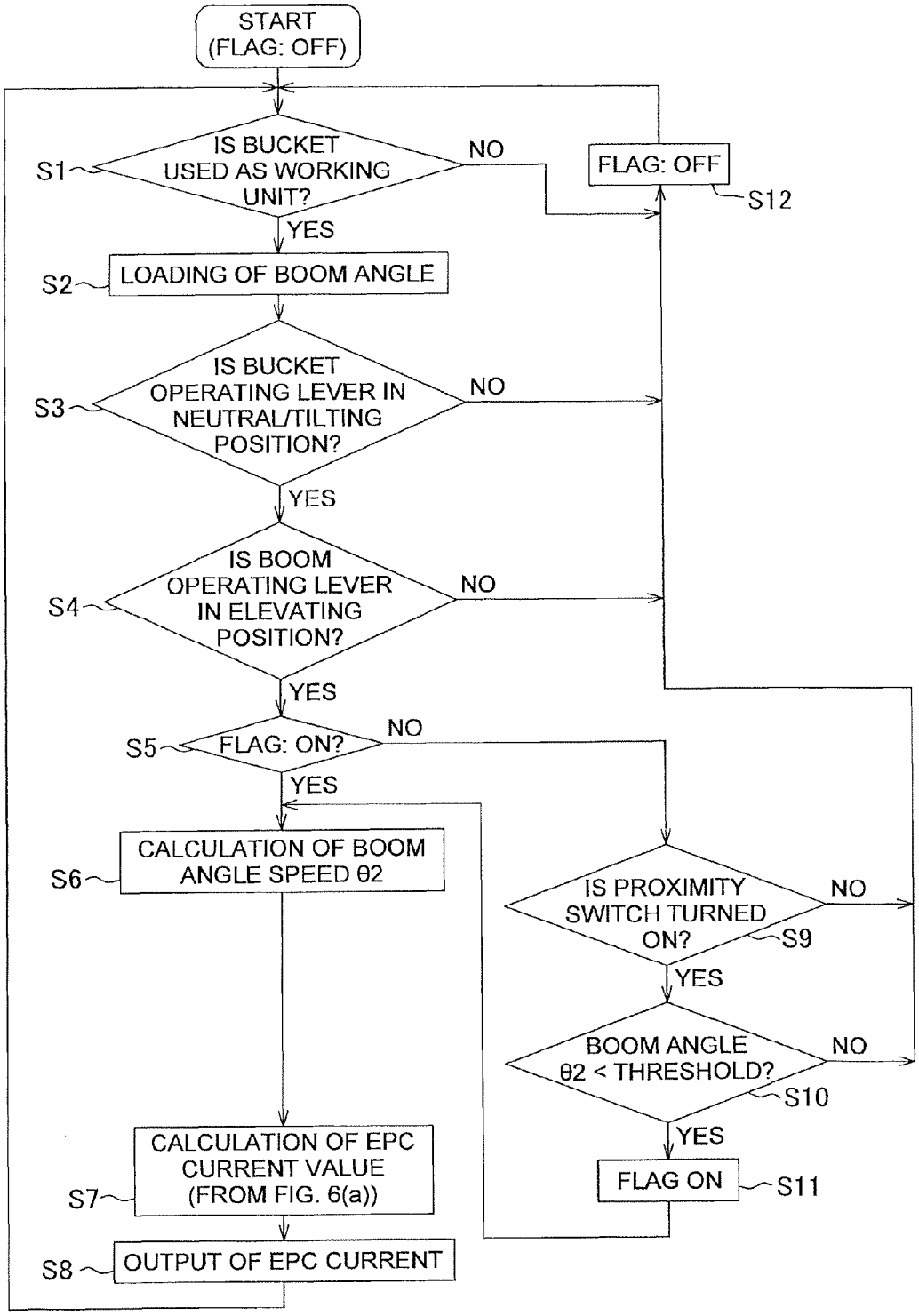
FIG. 4 is a flowchart representing a flow of a tilt angle adjusting control to be executed in the wheel loader of FIG. 1.

The wheel loader 50 of the present exemplary embodiment is configured to execute a control of adjusting the tilt angle of the bucket 53 based on the flowchart represented in FIG. 4 in executing works such as scooping up of earth and sand using the bucket 53 as illustrated in FIG. 2.

In the present exemplary embodiment, as described above, the bucket PPC valve 32 is configured to adjust the tilt angle of the bucket 53 in accordance with the operating amount of the operating lever. Further, the proximity switch 22*a* is configured to detect the bucket angle while the angle sensor is configured to measure the boom angle.

First in Step S1, it is checked whether or not the bucket 53 is attached as a working unit based on the working unit setting information from the monitor 31. The processing herein proceeds to Step S2 when attachment of the bucket 53 is confirmed. By contrast, the processing proceeds to Step S12 and a flag is turned "OFF" when an attachment different from the bucket is attached.

Next in Step S2, the controller 30 loads the boom angle therein. The aforementioned boom angle sensor (not illustrated in the figures) is herein configured to detect the boom angle.

Next in Step S3, it is checked whether or not the bucket operating lever is set to be in either the neutral position or the tilting position. The processing proceeds to Step S4 when the bucket operating lever is set to be in either the neutral position or the tilting position. Otherwise, the processing proceeds to Step S12 and the flag is turned "OFF". It should be noted that the operating position of the bucket operating lever can be determined by detecting the pilot pressure to be outputted from the bucket PPC valve 32.

In the present exemplary embodiment, the tilt angle adjusting control is configured to be executed when it is determined in Step S3 that the bucket operating lever is set to be in the tilting position as well as in the neutral position. The configuration is intended to prevent cancellation of the tilt angle adjusting control even when an operator performs a tilting operation during execution of the tilt angle adjusting control. When the tilt angle is not actually set to be an operator's intended tilt angle by executing the tilt angle adjusting control of the present exemplary embodiment, an operation of minutely adjusting the tilt angle is allowed to be executed during execution of the tilt angle adjusting control in order to set the tilt angle to be the operator's intended tilt angle.

Next in Step S4, it is checked whether or not the boom operating lever is operated for executing an elevating operation. The processing proceeds to Step S5 when the boom operating lever is operated for executing the elevating operation. Otherwise, the processing proceeds to Step S12 and the flag is turned "OFF". It should be noted that the position of the boom operating lever may be determined by detecting the pilot pressure to be outputted from the PPC valve, similarly to the determination of the position of the bucket operating lever.

Next in Step S5, it is checked whether the flag is being turned "ON". The processing proceeds to Step S6 when the flag is being turned "ON" in Step S5. By contrast, the processing proceeds to Step S9 when the flag is being turned "OFF".

Next in Step S6 where the flag is being turned "ON" in Step S5, a boom angle speed θ2 is calculated based on variation in boom angle per unit time.

Figure 5:
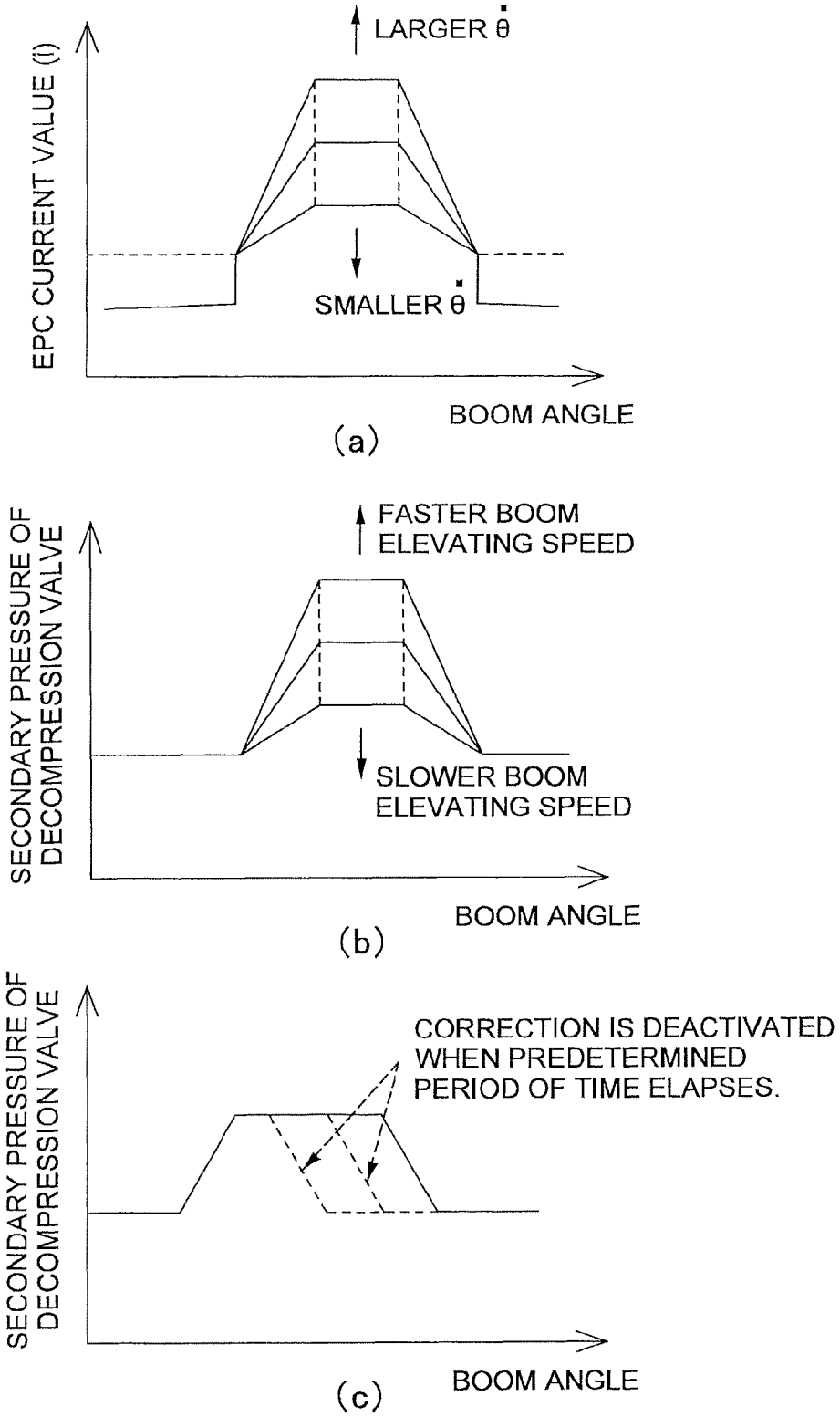
FIG. 5 includes a chart (a) representing variation in EPC current value with respect to boom angle in the tilt angle adjusting control of FIG. 4 and charts (b) and (c) representing variation in secondary pressure of a decompression valve with respect to boom angle in the tilt angle adjusting control of FIG. 4.

Next in Step S7, an EPC current value, corresponding to the boom angle speed θ2 calculated in Step S6, is calculated (see FIG. 5(*a*)). Accordingly, the bucket angle is changed by causing the secondary pressure of the decompression valve to vary in proportion to increase in the boom angle as represented in FIG. 5(*b*). It is thereby possible to execute a control of reducing the amount of scooped-up contents spilled out of the bucket 53 (see a solid line in FIG. 6). It should be noted that the EPC current value represented in FIG. 5(*a*) is adjustable based on the control amount adjusting information represented in FIG. 3.

Next in Step S8, the EPC current value calculated in Step S7 is outputted. Accordingly, the tilt angle of the bucket 53 can be automatically changed to a predetermined angle.

Subsequently, in Step S9 where the flag is being turned "OFF" in Step S5, it is checked whether or not the proximity switch 22*a* is being turned "ON", in other words, whether or not the tilt angle of the working unit is greater than or equal to a predetermined threshold. The processing proceeds to Step S10 when the proximity switch 22*a* is being turned "ON" in Step S9. By contrast, the processing proceeds to Step S12 when the proximity switch 22*a* is being turned "OFF" in Step S9. In Step S12, the flag is turned "OFF" and the processing returns to "START".

Next in Step S10, it is checked whether or not the boom angle θ2 is less than a predetermined threshold. The processing proceeds to Step S11 when the boom angle θ2 is less than the threshold in Step S10. By contrast, the processing proceeds to Step S12 and the flag is turned "OFF" when the boom angle θ2 is greater than or equal to the threshold in Step S10.

Next in Step S11, the flag is turned "ON" and the processing proceeds to Step S6.

It should be noted that the aforementioned tilt angle adjusting control may be executed for deactivating correction as depicted with a dotted line of FIG. 5(*c*), for instance, when three seconds or more elapses after the onset of variation in angle of the booms 52. Accordingly, the present control can be deactivated in other works excluding a work from scooping up of earth and sand with the bucket 53 to elevation of the booms 52.

Further, activation and deactivation of the aforementioned tilt angle adjusting control for the bucket 53 can be switched back and forth in accordance with operator's setting and the work content. Accordingly, activation of the aforementioned tilt angle adjusting control can be reliably prevented when a predetermined condition(s) is satisfied. In other words, the aforementioned tilt angle adjusting control can be executed only when necessary.

As described above, according to the wheel loader 50 of the present exemplary embodiment where the bucket 53 is attached as a working unit to the link mechanism 20 functioning as a parallel link motion mechanism as illustrated in FIG. 1, the controller 30 is configured to execute a control of adjusting the tilt angle of the bucket 53 in accordance with variation in angle of the booms 52 when the tilt angle of the bucket 53 disposed on the ground is greater than or equal to a predetermined threshold as represented in FIG. 4.

Thus, either activation or deactivation of the aforementioned control can be selected depending on whether or not the tilt angle of the bucket 53 is greater than or equal to the threshold. Accordingly, when a fork is attached as a working unit to the wheel loader 50, the tilt angle of the fork can be automatically controlled in elevating the booms 52 with the fork fully tilted. Even when the wheel loader 50 embedded with the parallel link motion mechanism executes works (e.g., scooping up of earth and sand) while the bucket 53 is attached thereto, the amount of contents spilled out of the bucket 53 can be reduced without making an operator control the bucket operating lever again. Consequently, an operator can operate the wheel loader 50 in executing works such as scooping up of earth and sand as if the operator operated a wheel loader embedded with a normal Z-bar link mechanism configured not to perform a parallel-link-like action.

Figure 6:
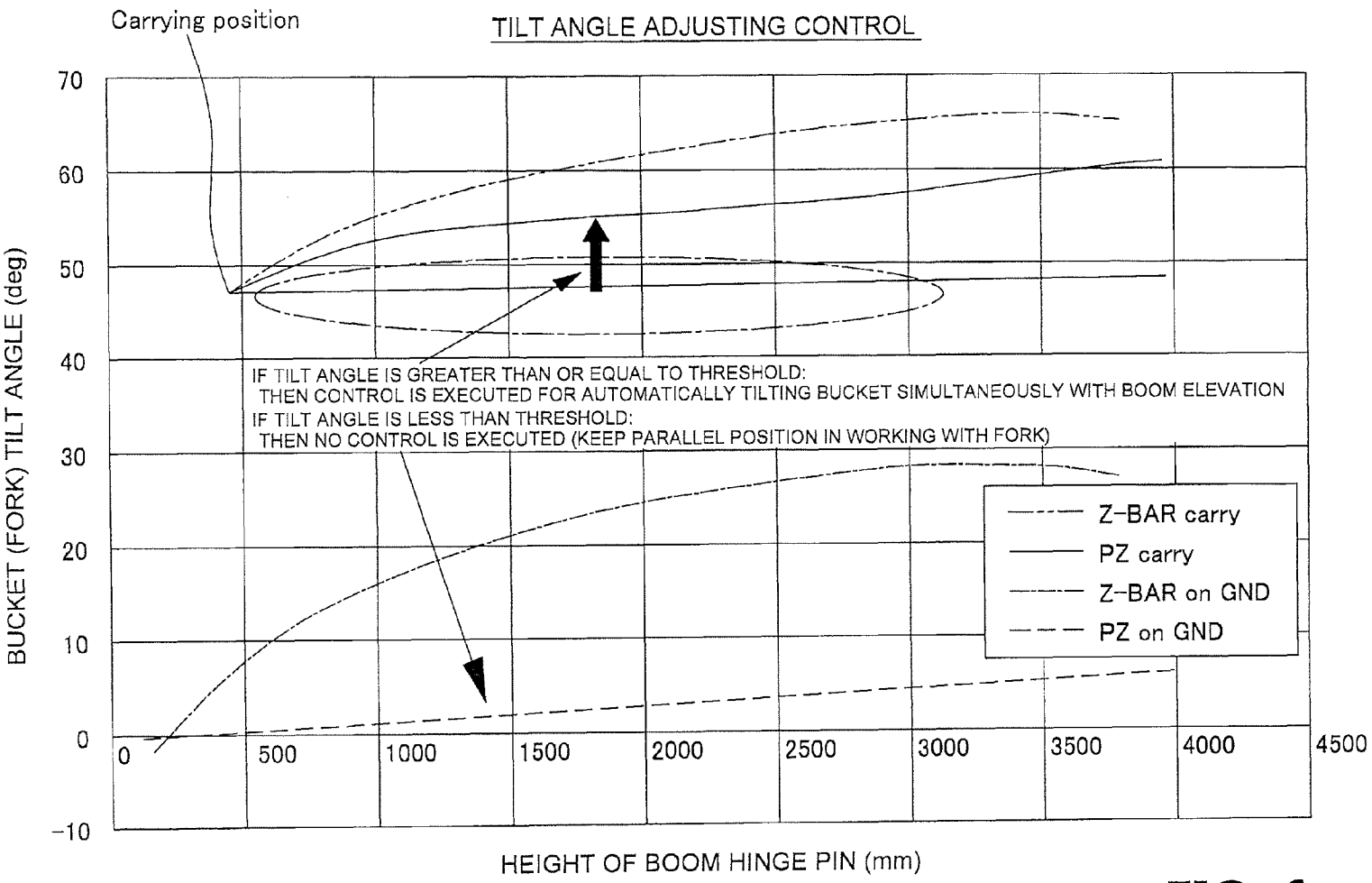
FIG. 6 is a chart representing variation in tilt angle under the tilt angle adjusting control to be processed based on the flowchart of FIG. 4.

More specifically, as represented in FIG. 6, the tilt angle adjusting control is executed by correcting the tilt angle to be gradually increased as depicted with a solid line in FIG. 6 in proportion to increase in height of hinge pins of the booms 52 (i.e., an elevated angle of the boom 52), although the tilt angle has been roughly linear in the well-known controls (see a dotted line in FIG. 6). Therefore, even the wheel loader 50 embedded with the parallel link motion mechanism can reduce the amount of contents spilled out of the bucket 53 by correcting the tilt angle in the same way as the Z-bar link mechanism depicted with a dashed two-dotted line in FIG. 6.

Exemplary Embodiment 2

Figure 8:
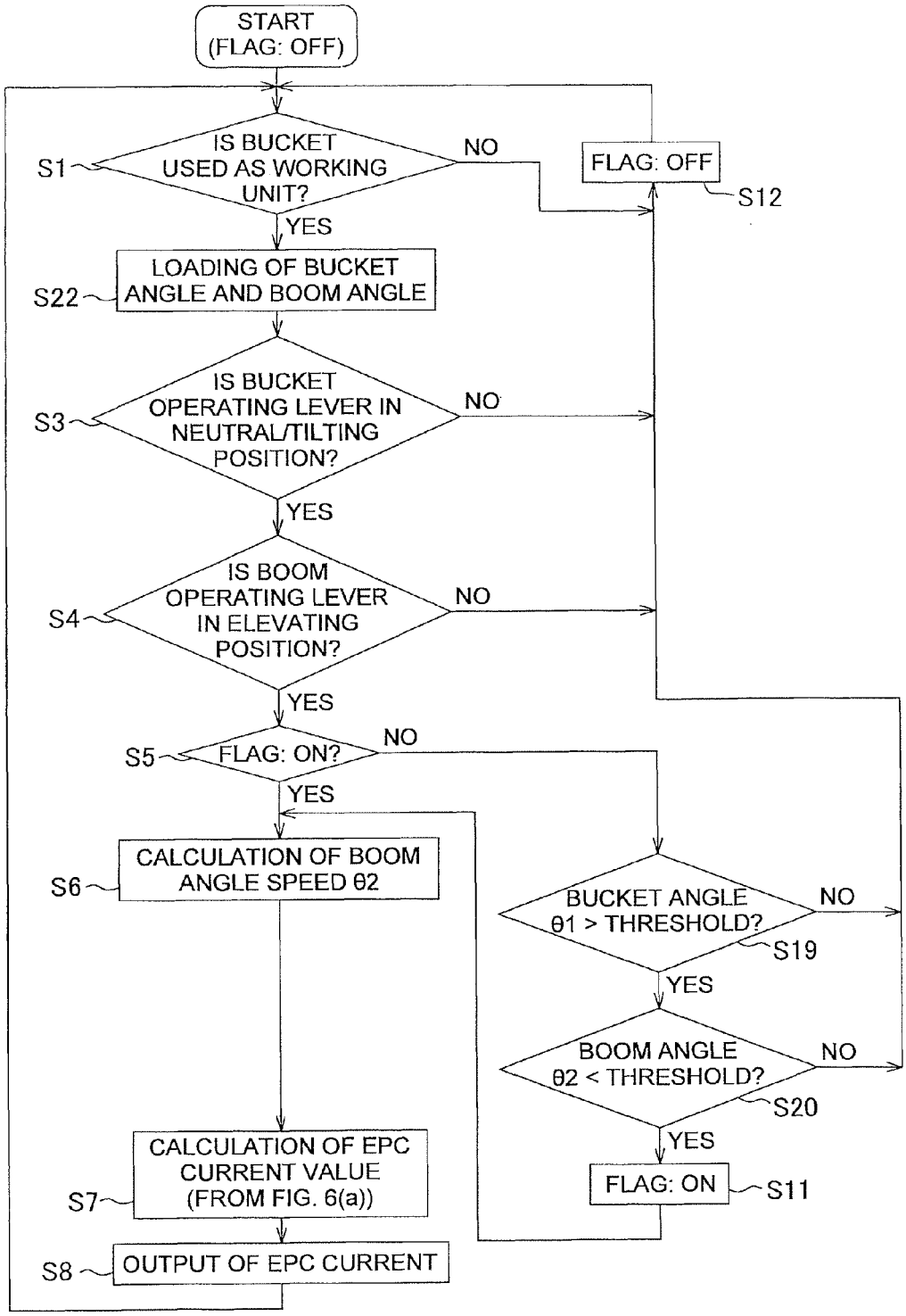
FIG. 8 is a flowchart representing a flow of a tilt angle adjusting control to be executed in the wheel loader according to another exemplary embodiment.

Another exemplary embodiment of the present invention will be hereinafter explained with reference to a flowchart of FIG. 8.

In the aforementioned exemplary embodiment 1, the proximity switch is configured to detect the bucket angle. In the present exemplary embodiment, by contrast, not the proximity switch but the angular sensor is used for detecting the bucket angle.

Specifically in Step S1, it is checked whether or not the bucket 53 is attached as a working unit to the wheel loader 50 based on the working unit setting information from the monitor 31. The processing proceeds to Step S2 when attachment of the bucket 53 is confirmed in Step S1. By contrast, the processing proceeds to Step S12 and the flag is turned "OFF" when a working unit other than the bucket is attached.

Next in Step S22, the controller 30 loads the bucket angle and the boom angle therein. Each of the tilt angle of the bucket 53 (i.e., the bucket angle) and the boom angle is herein detected using a normal boom angle sensor (not illustrated in the figures).

In should be noted that Steps S3 to S8 are similar to those in the aforementioned exemplary embodiment 1 and explanation thereof will be hereinafter omitted.

Next in Step S19 where the flag is being turned "OFF" in Step S5, it is checked whether or not a bucket angle θ1 is greater than a predetermined threshold. The processing proceeds to Step S20 when the bucket angle θ1 is greater than the predetermined threshold in Step S19. By contrast, the processing proceeds to Step S12 when the bucket angle θ1 is less than or equal to the predetermined threshold in Step S19. In Step S12, the flag is turned "OFF" and the processing returns to "START".

Next in Step S20, it is checked whether or not the boom angle θ2 is less than a predetermined threshold. The processing proceeds to Step S11 when the boom angle θ2 is less than the predetermined threshold in Step S20. By contrast, the processing proceeds to Step S12 and the flag is turned "OFF" when the boom angle θ2 is greater than or equal to the predetermined threshold.

Next in Step S11, the flag is turned "ON" and the processing proceeds to Step S6.

Exemplary Embodiment 3

Yet another exemplary embodiment of the present invention will be hereinafter explained with reference to a flowchart of FIG. 9.

In the aforementioned exemplary embodiments 1 and 2, the tilt angle of the bucket 53 is configured to be adjusted using the bucket PPC valve 32 in accordance with the operating amount of the operating lever. In the present exemplary embodiment, however, the tilt angle of the bucket 53 is configured to be adjusted using an EPC valve instead of the PPC valve. The configuration of the present exemplary embodiment will be hereinafter explained.

Figure 7:
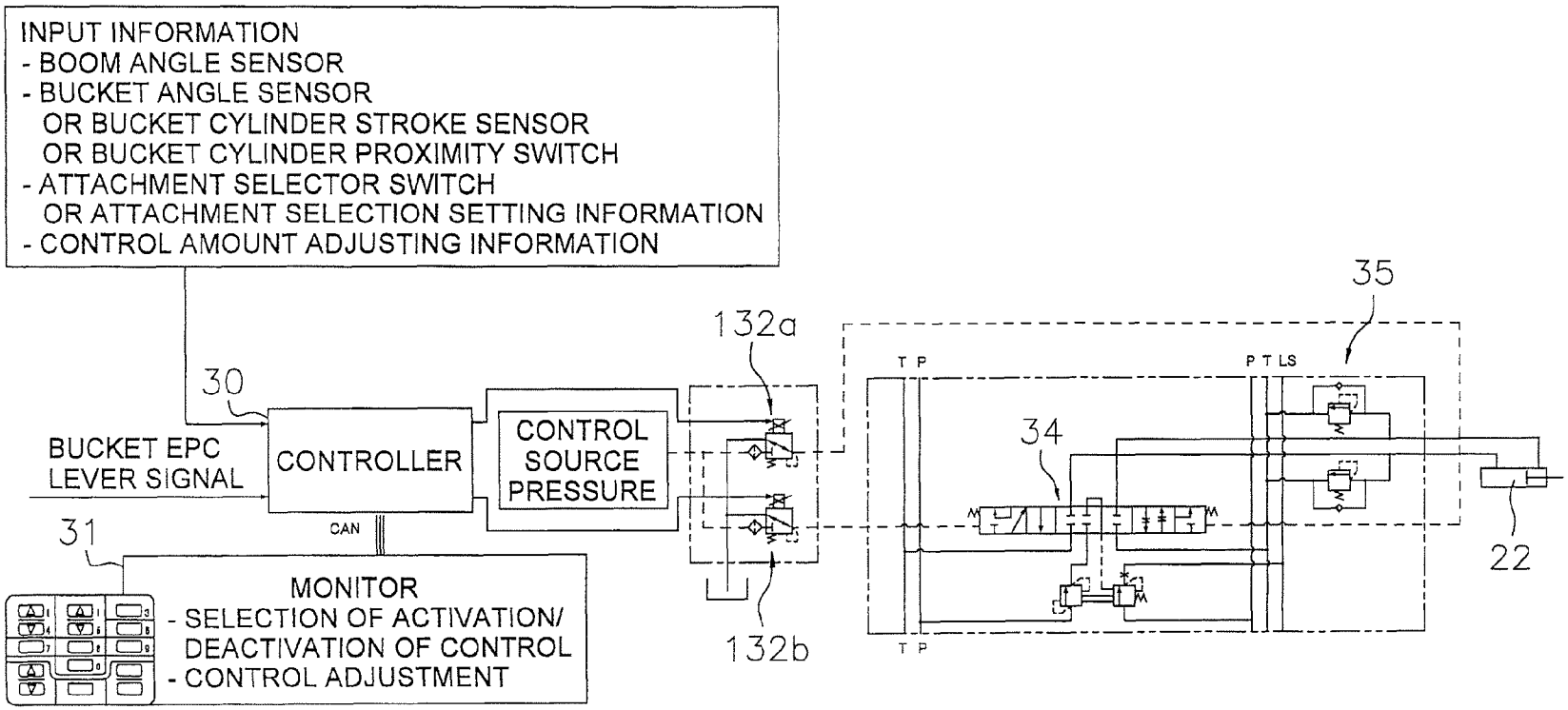
FIG. 7 is a circuit diagram of a hydraulic circuit for driving a bucket cylinder installed in a wheel loader according to another exemplary embodiment of the present invention.

In the present exemplary embodiment, a signal indicating the operating amount of the bucket operating lever is inputted into the controller 30 as represented in FIG. 7. EPC decompression valves 132*a* and 132*b* are disposed within the bucket spool actuating circuit. The controller 30 is configured to output a command current to the EPC decompression valves 132*a* and 132*b* in accordance with the operating amount of the bucket operating lever. Accordingly, the bucket 53 is actuated. It should be noted that the EPC decompression valves 132*a* and 132*b* may be embedded in the main valve or externally attached to the valve.

Similarly to the aforementioned exemplary embodiment 2, the angle sensors are configured to detect both the bucket angle and the boom angle in the present exemplary embodiment.

Further similarly to the aforementioned exemplary embodiments 1 and 2, the controller 30 is connected to the monitor 31 and is configured to receive a variety of input signals carrying information regarding the boom angle sensor, information regarding the bucket angle sensor, the control amount adjusting information related to the tilt angle adjusting control, the working unit setting information and so forth.

Further similarly to the aforementioned exemplary embodiments 1 and 2, the monitor 31 is configured to receive a variety of information directly inputted by an operator regarding selection of activation/deactivation of the tilt angle adjusting control, adjustment of the control amount, and further the working unit setting information.

Figure 9:
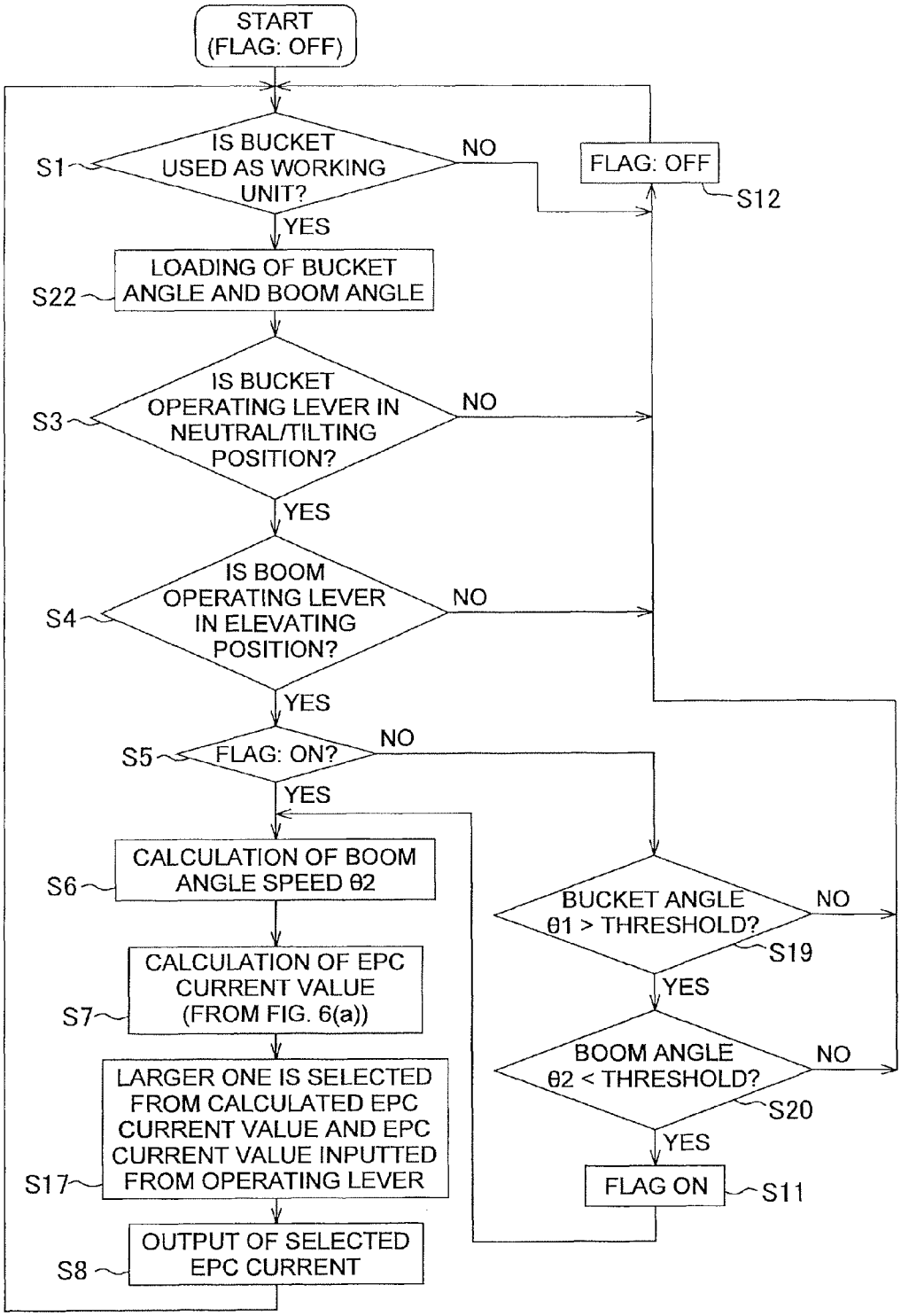
FIG. 9 is a flowchart representing a flow of a tilt angle adjusting control to be executed in a wheel loader according to yet another exemplary embodiment of the present invention.

The controller 30 is configured to execute a control represented in a flowchart of FIG. 9.

Specifically in Step S1, it is checked whether or not the bucket 53 is attached as a working unit to the wheel loader 50 based on a signal from the monitor 31 and so forth. The processing proceeds to Step S2 when attachment of the bucket 53 is confirmed in Step S1. By contrast, the processing proceeds to Step S12 and the flag is turned "OFF" when an attachment other than the bucket is attached to the wheel loader 50.

Next in Step S22, the controller 30 loads the bucket angle and the boom angle therein.

Steps S3 to S7 are similar to those of the aforementioned exemplary embodiment 1.

Unlike the aforementioned exemplary embodiments 1 and 2, Step S17 is executed after Step S7 in the present exemplary embodiment.

In Step S17, a larger one selected from the EPC current value calculated in Step S7 and the EPC current value inputted from the operating lever. The reason for selecting a larger one of the EPC current values is that it is required to electrically compensate the function of the higher pressure selector valve 35 represented in FIG. 3 when the EPC decompression valves 132*a* and 132*b* are used through the operation of the bucket operating lever.

Steps S8, S11, S12, S19 and S20 are the same as those in the aforementioned exemplary embodiment 2 represented in FIG. 8, and explanation thereof will be hereinafter omitted.

Exemplary Embodiment 4

Yet another exemplary embodiment of the present invention will be hereinafter explained with reference to a flowchart of FIG. 10.

In the aforementioned exemplary embodiment 3, the angular sensor is configured to detect the bucket angle. In the present exemplary embodiment, by contrast, the proximity switch 22*a* is used for detecting the bucket angle instead of the angular sensor as seen in the aforementioned exemplary embodiment 1. In this case, the controller 30 is configured to execute a control represented in the flowchart of FIG. 10.

Figure 10:
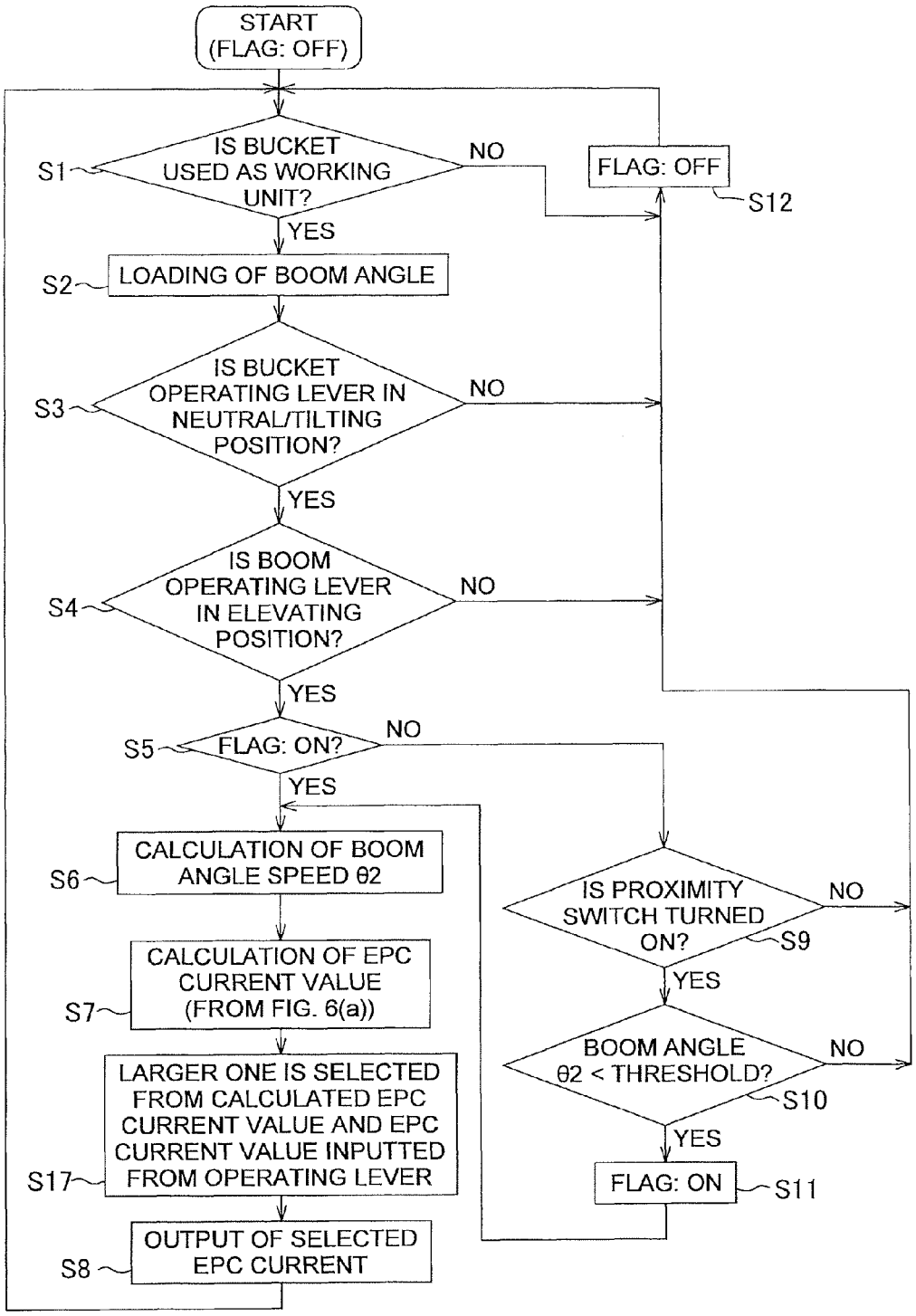
FIG. 10 is a flowchart representing a flow of a tilt angle adjusting control to be executed in wheel loader according to yet another exemplary embodiment of the present invention.

The flowchart of FIG. 10 is produced only by exchanging Step S19 in the flowchart of FIG. 9 with Step S9 in the flowchart of FIG. 4. In other words, the other steps in the flowchart of FIG. 10 are the same as those of the flowchart of FIG. 9, and detailed explanation thereof will be hereinafter omitted.

Other Exemplary Embodiments

The exemplary embodiments of the present invention have been explained above. However, the present invention is not limited to the aforementioned exemplary embodiments, and a variety of changes can be herein made without departing from the scope of the present invention.

(A) The aforementioned exemplary embodiments have been explained with exemplary cases that the wheel loader 50 is embedded with a mechanism configured to perform a parallel-link-like action using the Z-bar link. In the present invention, however, the application target of the present invention is not limited to the above.

The present invention can be applied to the work vehicles embedded with a mechanism configured to keep a working unit in a posture parallel to the ground in elevating the booms from the position where the fork is disposed on the ground when a fork is attached as the working unit to the tips of the booms. For example, the present invention may be applied to a work vehicle embedded with so-called a normal parallel link mechanism.

(B) The aforementioned exemplary embodiments have been explained with exemplary cases that the tilt angle adjusting control is executed based on so-called an open control. In the present invention, however, the method of executing the tilt angle adjusting control is not limited to the above.

For example, a feedback control may be executed based on a detection of a difference between the current bucket angle and a target tilt angle.

(C) The aforementioned exemplary embodiments have been explained with exemplary cases that only one threshold (i.e., the lower limit), falling in an angular range of 35 to 40 degrees, is set as the threshold for determining activation/deactivation of the aforementioned tilt angle adjusting control. In the present invention, however, the threshold setting is not limited to the above.

For example, both of the upper limit and the lower limit may be set as the thresholds for the tilt angle adjusting control.

(D) The aforementioned exemplary embodiments have been explained with exemplary cases that the bucket angle is detected by the proximity switch 22*a* or the angle sensor. In the present invention, however, the device for detecting the bucket angle is not limited to the above.

For example, the bucket angle may be detected by a bucket cylinder stroke sensor.

(E) The aforementioned exemplary embodiments have been explained with exemplary cases that the wheel loader 50 is used as a work vehicle adopting the present invention. However, the application target of the present invention is not limited to the above.

For example, the present invention may be applied to a variety of work vehicles such as the construction vehicles configured to execute works using a bucket attached thereto, regardless of the work vehicle types such as a self-propelled type and a stationary type.

According to the illustrated embodiments, even the work vehicles such as the wheel loaders embedded with a parallel link motion mechanism can achieve an advantageous effect that works can be efficiently executed with a bucket without degrading work performance in attachment of the bucket. Therefore, the present invention can be widely applied to a variety of work vehicles such as the construction vehicles configured to execute works using a bucket attached thereto.

The invention claimed is:

1. A work vehicle comprising:

a pair of booms attached to a front part of a vehicle body in an upwardly and downwardly rotatable state;

a parallel link motion mechanism coupling a working unit to tips of the booms, the parallel link motion mechanism keeping the working unit in a posture generally parallel to the ground without rotating the working unit with respect to the ground while the booms are elevated from a position where the working unit is disposed on the ground when the working unit is a fork; and a control unit monitoring an angle of the booms and a tilt angle of the working unit;

the control unit executing a tilt angle adjusting control of the working unit in accordance with variation in the angle of the booms while the booms are elevated from the position where the working unit is disposed on the ground when the tilt angle of the working unit is greater than or equal to a predetermined threshold; and the control unit not executing the tilt angle adjusting control when the working unit is a fork such that the parallel posture of the working unit is maintained by the parallel link motion mechanism.

2. The work vehicle recited in claim 1, wherein the predetermined threshold is at least one of a first threshold as an upper limit and a second threshold as a lower limit.

3. The work vehicle recited in claim 1, wherein the threshold is variable.

4. The work vehicle recited in claim 1, wherein the threshold is set to be in an angular range of about 35 to 40 degrees.

5. The work vehicle recited in claim 1, further comprising:

a selection mechanism configured to switch between activation and deactivation of the tilt angle adjusting control.

6. The work vehicle recited in claim 1, further comprising:

a tilt correction amount adjusting mechanism configured to adjust a control amount of the tilt angle in the tilt angle adjusting control.

7. The work vehicle recited in claim 1, further comprising:

a proximity switch arranged and configured to detect whether the tilt angle of the working unit has exceeded the predetermined threshold, the proximity switch being operatively coupled to the control unit, the control unit being configured to determine whether the tilt angle of the working unit is greater than or equal to a predetermined threshold based on an ON-OFF state of the proximity switch.

8. The work vehicle recited in claim 1, further comprising:

a working unit cylinder operatively coupled to the working unit, the working unit cylinder being configured to actuate tilting of the working unit at least when the working unit is the bucket, the parallel link motion mechanism being configured to keep the working unit in the posture generally parallel to the ground without the working unit cylinder being operated when the working unit is the fork.

9. The work vehicle recited in claim 8, further comprising:

a working unit operating lever operatively coupled to the working unit cylinder and the control unit, the working unit operating lever being moveable to a tilting position, a neutral position, and a dumping position for operating the bucket when the working unit is the bucket;

a boom cylinder operatively coupled to the booms, the boom cylinder being configured to actuate elevation and lowering of the booms; and a boom operating lever operatively coupled to the boom cylinder and the control unit, the boom operating lever being moveable to an elevating position for elevating the booms, the control unit being configured to execute the tilt angle adjusting control only if the working unit operating lever is in the neutral position or the tilting position and the boom operating lever is in the elevating position.

10. A work vehicle comprising:

a pair of booms attached to a front part of a vehicle body in an upwardly and downwardly rotatable state;

a parallel link motion mechanism interchangeably coupling either one of a fork and a bucket as a working unit to tips of the booms, the parallel link motion mechanism keeping the working unit in a posture generally parallel to the ground without rotating the working unit with respect to the ground while the booms are elevated from a position where the working unit is disposed on the ground when the working unit is the fork; and a control unit monitoring an angle of the booms and a tilt angle of the working unit;

the control unit executing a tilt angle adjusting control of the working unit when the working unit is the bucket, the tilt angle adjusting control being executed in accordance with variation in the angle of the booms while the booms are elevated from the position where the working unit is disposed on the ground when the tilt angle of the working unit is greater than or equal to a predetermined threshold;

the control unit not executing the tilt angle adjusting control when the tilt angle of the working unit is smaller than the predetermined threshold; and the control unit not executing the tilt angle adjusting control such that the parallel posture of the working unit is maintained by the parallel link motion mechanism when the working unit is the fork.

11. The work vehicle recited in claim 10, wherein the predetermined threshold is at least one of a first threshold as an upper limit and a second threshold as a lower limit.

12. The work vehicle recited in claim 10, wherein the threshold is variable.

13. The work vehicle recited in claim 10, wherein the threshold is set to be in an angular range of about 35 to 40 degrees.

14. The work vehicle recited in claim 10, further comprising:

a selection mechanism configured to switch between activation and deactivation of the tilt angle adjusting control.

15. The work vehicle recited in claim 10, further comprising:

a tilt correction amount adjusting mechanism configured to adjust a control amount of the tilt angle in the tilt angle adjusting control.

16. The work vehicle recited in claim 10, further comprising:

a proximity switch arranged and configured to detect whether the tilt angle of the working unit has exceeded the predetermined threshold, the proximity switch being operatively coupled to the control unit, the control unit being configured to determine whether the tilt angle of the working unit is greater than or equal to a predetermined threshold based on an ON-OFF state of the proximity switch.

17. The work vehicle recited in claim 10, further comprising:

a working unit cylinder operatively coupled to the working unit, the working unit cylinder being configured to actuate tilting of the working unit at least when the working unit is the bucket, the parallel link motion mechanism being configured to keep the working unit in the posture generally parallel to the ground without the working unit cylinder being operated when the working unit is the fork.

18. The work vehicle recited in claim 17, further comprising:

a working unit operating lever operatively coupled to the working unit cylinder and the control unit, the working unit operating lever being moveable to a tilting position, a neutral position, and a dumping position for operating the bucket when the working unit is the bucket;

a boom cylinder operatively coupled to the booms, the boom cylinder being configured to actuate elevation and lowering of the booms; and a boom operating lever operatively coupled to the boom cylinder and the control unit, the boom operating lever being moveable to an elevating position for elevating the booms, the control unit being configured to execute the tilt angle adjusting control only if the working unit operating lever is in the neutral position or the tilting position and the boom operating lever is in the elevating position.

* * * * *